United States Patent [19]

Grose

[11] Patent Number: 4,742,772

[45] Date of Patent: May 10, 1988

[54] RAPID SETUP PRINTING PRESS WITH QUICK RELEASE PRINTING PLATE RETAINER

[76] Inventor: Gregory A. Grose, 6 Creek Cir., Seaford, Va. 23696

[21] Appl. No.: 29,051

[22] Filed: Mar. 23, 1987

Related U.S. Application Data

[62] Division of Ser. No. 877,239, Jun. 23, 1986, abandoned.

[51] Int. Cl.[4] ..... B41F 27/06; B41F 7/22

[52] U.S. Cl. ..... 101/415.1; 101/228

[58] Field of Search ..... 101/415.1, 378, 228

[56] References Cited

U.S. PATENT DOCUMENTS 3,869,985 3/1975 Steinmetz ..... 101/415.1

*Primary Examiner*—J. Reed Fisher

*Attorney, Agent, or Firm*—Martin Fruitman

[57] ABSTRACT

A modular three color printing press with computer process control and monitoring of the print parameters. Integral ink modules which are easily removed and replaced to change color and dial control of the print length and auxilliary processes yield a press with highly accurate registry, minimum paper distortion, and minimal set-up time and paper waste for short runs. Computer controlled motion of the paper web permits infinite instantaneous variations of print length up to the maximum length of the printing impression plate, this permiting various lengths of product with no waste of paper.

2 Claims, 5 Drawing Sheets

16

RAPID SETUP PRINTING PRESS WITH QUICK RELEASE PRINTING PLATE RETAINER

This is a division of application Ser. No. 877,239 filed Jun. 23, 1986, now abandoned.

SUMMARY OF THE INVENTION

This invention deals generally with printing presses and more specifically with a multiple color, modular inking, printing press and a control system which enables rapid changeover from one size product to another.

It is well understood in the economics of the printing industry that low quantity production, so called "short runs", are limited by the time required to set up the printing press with print size and color changes for the specific job. In the extreme case, it is clearly uneconomical to use the traditional three sequential printing towers, with the inherent problems of registry between them, to print only a few items. With the involved set-up of three individual presses and the many trial prints required to accomplish satisfactory registry, the actual printing time could be inconsequential relative to the preparation time. The cost of making a short run is therefore virtually the same as making a long run.

The solution to this problem lies in reducing the setup waste and setup time by reducing the number of printing towers from three to one. With all three colors being printed on one machine the registry problem of sequentially printed colors is eliminated. Registry is instead determined by the accuracy with which the three-in-one printing plate is manufactured.

The single printing tower obviously also reduces the installation of three printing plates to the installation of only one, thus cutting the set-up labor to one-third of that traditionally required.

The present invention takes this concept further by independently controlling the paper length of the printed product regardless of the impression length of the press, by modularizing the ink feed system so that modification, omission, or cleaning of an ink fountain requires no down time since it is performed offline, by using a quick release clamp to attach the printing plate, and by holding the paper stationary during startup and shutdown of the press.

The adjustment of paper length is accomplished by retraction, reverse motion, of the paper after each movement caused by the impression couple. As the press blanket cylinder and the raised portion of the impression cylinder meet to print the paper, their force on the paper moves the continuous web forward by the entire length of the raised portion of the impression cylinder regardless of what length actually is printed. Without retraction this entire length of paper would be used regardless of the length of the printing required. As noted in U.S. Pat. No. 3,548,747 by D'Amato, the quantity of paper used can be reduced by a mechanism which retracts the paper backward past the printing couple so that the next print begins where the previous one terminated. This permits the quantity of paper used to be determined by the size of the printed item, not the length of the raised segment of the impression cylinder, and permits the changeover of a press from one job to another by merely changing the one printing plate and adjusting the print length control appropriately.

However, while this sounds like a simple matter, the speed at which the printing takes place, the inertia of the various parts, including the paper web itself, and the accuracy required in production, makes it quite difficult for all but the most experienced printing press operators to quickly and accurately set up the press and produce good results.

This problem is further aggrevated by the tendency of the forward and reverse motions of the paper web to cause stress which results in tearing of the paper if the timing of the motions is not exact and does not also take into account the stress on the paper caused by the acceleration and deceleration of the paper web each time it moves. The likelihood of damage is particularly increased because one paper drive mechanism frequently used in the printing process is the combination of holes in the paper margin and sprockets on the press to move the paper as it normally is moved in computer applications. This method has positive interaction between the drive and the paper, and yields highly accurate and repeatable motion. However, this same positive interaction can cause severe stress on the paper holes if the forward and reverse motions are not properly controlled.

The present invention furnishes this highly accurate coordination of the opposing motions and permits operation by personnel with a lower lever of experience, while also furnishing instantaneous adjustment by the use of a system of automatic feedback control of the parameters of the printing operation.

This control system begins with a print cylinder encoder, a tachometer and an optical switch which furnish electrical signals corresponding to the speed and position of the plate cylinder. This information is forwarded to the process controller. The process controller controls the motion of the forward paper drive not only as to its speed and length of operation, but also for the timing of its start; the acceleration ramp, that is the time and magnitude of the acceleration; the deceleration ramp; and the timing of the recall force. In order to properly control these parameters the process controller not only controls the forward paper drive stepping motor but also received signals from a forward paper drive encoder which furnishes electrical signals from the forward paper drive corresponding to the actual movement of the drive.

A manual control station for operator control is also included. It converts manual settings in inches of desired print length, which are entered by the machine operator, to appropriate electrical signals for the process controller and permits adjustment of the registration of the printed matter relative to feature on the paper, such as perforations, even while the press is in operation. An additional optical shaft encoder on the paper drive sends an input to the process controller to assure precise forward motion. The process controller counts pulses to measure the movement. If the result is incorrect it moves the paper again, but incorrect results after three attempts shuts the press down.

The process controller controls the motion of the paper web to move it forward during each print cycle at speeds and accelerations controlled so that it is not damaged, and it accomplishes this, regardless of the speed of the press or the actual print length, by varying the acceleration and deceleration of the paper with the press speed.

In the preferred emodiment, for instance, the timing is fixed so that the web is completely free to move while the printing couple is driving it forward, that is, as the printing is taking place no other motion is being imparted to the paper, either forward or backward. In such an arrangement the paper is therefore not subjected to any external stress or distortion while being printed, but feeds into a storage loop on the downstream side of the printing couple.

It is when the printing couple releases the paper that the total paper web is moved forward. This is accomplished by moving it forward, with controlled and limited acceleration, a distance exactly equal to the print frame length, and also retracting any excess length which was moved forward by the printing couple but not by the forward web motion, so that the unprinted portion of the length is moved backward and can be used on the next print cycle.

The process controller of the present invention permits instantaneous accomodation to change of printing frame length while, at all times, restricting the magnitude and timing of the acceleration of the forward and reverse paper drives so that the paper is not subject to damaging stress.

The process controller also sequences the start-up and shut down of the press to minimize the number of misprinted sheets at start-up by preventing paper movement until the press is fully prepared to print. The prescribed sequence of the initiation of each action is determined by the manufacturer for most efficient operation, and is adjustable only by service personnel, so that operator judgement, and misjudgement, is eliminated. The capability of current process control technology is, however, capable of adjusting these setting, if necessary, instantaneously and remotely, for instance by telephone access.

This control sequence essentially initiates the application of the fountain solution, the ink repelling liquid, to the plate cylinder before initiating application of the inks. Moreover, the timing sequence also assures that the fluid supplies, both the inks and the fountain solution, are only made available at appropriate times relative to the application of the respective rollers to the plate cylinder. The sequence thus assures the proper balance of ink and repelling liquid on the plate cylinder at the right time to deliver a perfect three color print after only one or two impressions on the paper. Such minimum waste is virtually unknown in wet offset printing presses. Moreover, the only operator action required to accomplish this is the threading of the paper web through the press and the activation of one control.

On shut down of the printing operation, the process controller similarly determines a sequence which performs all required operations automatically to leave the printing plate cleaned of ink and the plate cylinder oriented properly for easy and rapid replacement with the next printing plate.

This is accomplished by first lifting the ink rollers from the plate cylinder and then, after a few revolutions during which the ink is removed from the plate by the action of printing the paper, stopping the paper and the fountain solution supply, and, finally, stopping the cylinder in the exact orientation needed for easy access for plate removal and replacement.

The savings in paper by retraction of the excess pulled through by an excessively long printing plate can, however, be easily lost if set-up time on such a press is not also minimized. To this end, a unique quick release printing plate clamp is used in the present invention which permits the printing plate to be released with a single motion in the direction parallel to the axis of the plate cylinder. Together with precise rotational control of the plate cylinder, this permits stopping the plate cylinder in a particular orientation and actuating a specific mechanism, such as a pneumatic cylinder, to release the plate at the activation of a single control, and to reduce the plate replacement time to under one minute.

The present invention enables changes of ink color in little, if any, additional time. This is possible because the entire inking mechanism for each color is assembled onto a single demountable module. Each of these modules locks into a mating support on the press and is powered by a gear drive with which it engages. The only additional controls on each module are pneumatic supply lines attachable and detachable by conventional quick disconnect couplings, and the raised cams on the plate cylinder against which the control wheels of the inking roller ride. These cams are the method of assuring that each inking roller contacts only that portion of the plate which is intended for the color of that ink roller, and that the ink roller of that color is lifted off from the printing plate while other portions of the printing plate pass under it.

The present invention therefore eliminates most of the manual processes in the printing process. It permits rapid change or resupply of ink color; it allows automatic instantaneous adjustment of the length of paper printed and the orientation of the printing relative to the paper length; it automatically controls both the start-up and shut down sequence; it stops the printing plate cylinder at an accessable orientation and automatically releases the printing plate for replacement and it accomplishes the change of all the color images with the change of one plate, rather than one plate for each color.

By leaving only the removal and replacement of the single printing plate and threading of new paper as manual operations, it permits high speed wet offset printing to be used economically for lower quantity "short" runs that were ever before possible.

BRIEF DESCRIPTION OF THE FIGURES

FIG. 1, in two overlapping parts.

DETAILED DESCRIPTION OF THE INVENTION

Figure 1A:
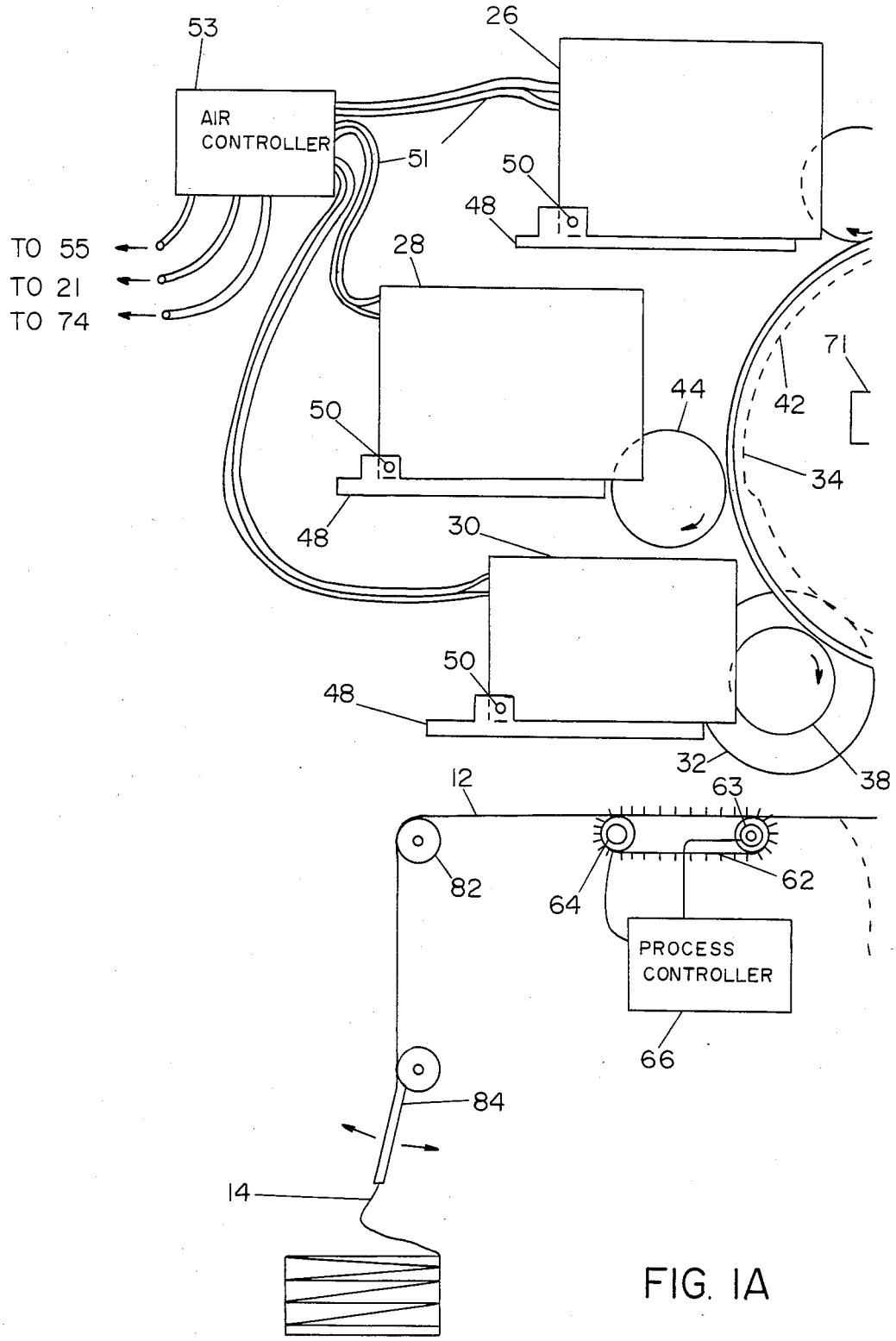
FIG. 1A and FIG. 1B, is a simplified schematic representation of the preferred embodiment of the printing press of the invention.
Figure 1B:
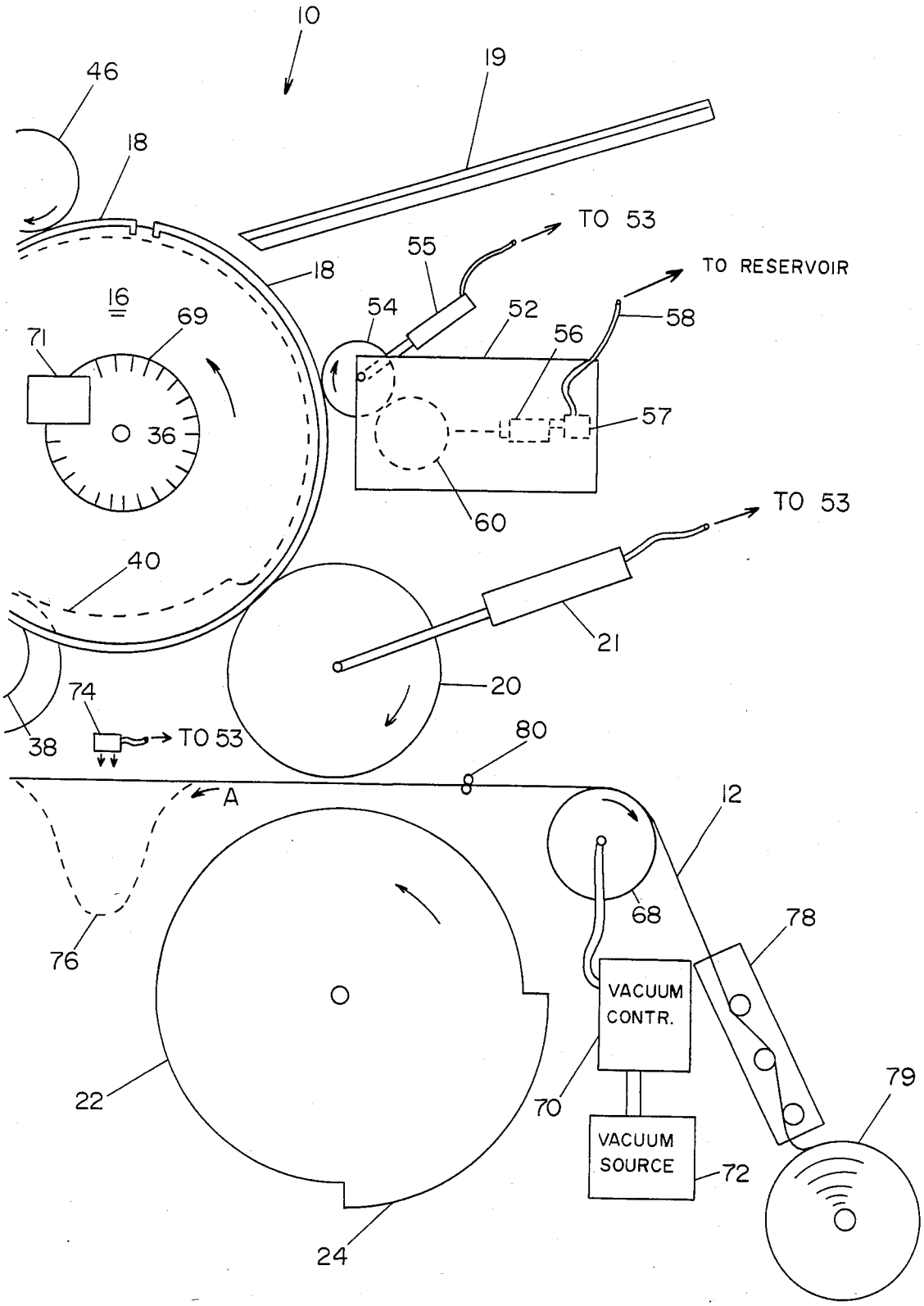

A preferred embodiment of the invention is shown in FIG. 1 which is a simplified schematic representation of wet offset printing press 10 of the invention by which prepunched, preperforated paper 12 is printed and refolded into typical forms 14 for use in later computer processing.

One of basic components of printing press 10 is plate cylinder 16 upon the cylindrical surface of which is mounted printing plate 18. Printing pate 18 is essentially divided into three equal areas, one for each of the colors to be printed, and each area is prepared in a conventional manner with the image which is to be printed in its individual color.

During the printing process, plate cylinder 16 is placed in rolling contact with blanket cylinder 20 and each different colored section of printing plate 18 sequentially transfer its image to blanket cylinder 20, one on top of the other. Blanket cylinder 20 thus accumulates a total three color image for transfer onto paper 12. The rolling contact of blanket cylinder 20 with plate cylinder 16 and impression cylinder 22 is controlled by pneumatic cylinder 21 which itself is controlled by air controller 53.

The transfer takes place when impression cylinder 22, with raised surface 24 comprising only about one-quarter of the total circumference, pinches paper 12 between raised portion 24 and blanket cylinder 20 referred to as the printing couple. The three cylinders 16, 20 and 24 are linked together by gears (not shown) so that their relative speeds and orientation are precisely predetermined to assure proper printing.

Three separate ink modules 26, 28 and 30 are required for printing press 10, one each for each of the three segments of printing plate 18. The contact of each ink module with printing plate 18 is controlled by the combination of wheel 32 and cam 34. This system is shown only in regard to ink module 30 and consists of ring cam 34 concentric to plate cylinder axis 36 upon which rides wheel 32, concentric with ink roller 38 of ink module 30. The smaller radius segments 40 of cam 34 permit ink roller 38 to roll against printing plate 18 for approximately one-third of each revolution of plate cylinder 16, while the raised portion 42 of cam 34 pushes ink roller 38 away from printing plate 18 for the balance of each revolution. It is while ink roller 38 is not in contact with printing plate 18 that each of the other ink rollers 44 and 46 are in turn, placed in rolling contact with printing plate 18 by their respective cam systems. Air pressure is used to produce the force opposing cam 34.

An important feature at the present invention is the modularized system of inking. As depicted in FIG. 1, each ink module 26, 28 and 30 is supported by sliding guide 48 and locked into place by pins 50 (matching pin on opposite side of module not visible). To remove an ink module for purposes of cleaning, repair, omission of color, or change of ink color, it is only necessary to remove pins 50 and pull the module back from plate cylinder 16, completely off of guide 48. Another similar module may then be installed in its place while the first module is being worked on.

The wet offset printing process of the preferred embodiment also requires a supply of fountain solution, composed essentially of water. This is provided by liquid assembly 52, which, during operation continually rolls fountain solution onto printing plate 18 by means of liquid roller 54, whose initial contact with printing plate 18 is controlled by pneumatic cylinder 55, itself controlled by pneumatic air controller 53. The liquid is supplied by a group of spray nozzles 56 which are oriented in a configuration parallel to the axis of the several rollers. The nozzles are supplied with fountain solution through tubing 58 from liquid pump 57 which takes the liquid from a reservoir (not shown). The fountain solution is sprayed onto intermediate roller 60 which dispenses it onto liquid roller 54 from which it is rolled onto printing plate 18.

The fountain solution serves to wet those parts of printing plate 18 which are not intended to be covered by ink, since it repels the oil in the ink.

As can be easily understood from the relationship of blanket cylinder 20 and impression cylinder 22, the only contact between them is when the raised portion 24 of impression cylinder 22 is adjacent to blanket cylinder 20. The printing couple formed by these mating rotating parts, between which paper 12 is threaded, pinches the paper and moves it forward in direction A on FIG. 1. An important aspect of the present invention is the precise timing of the other motions imparted to paper 12 so as not to tear or distort the paper. Since a common type of paper upon which printing is required is paper which is perforated at regular intervals, it is apparent that any stress on such paper can cause a tear and thereby disrupt the printing process.

The present invention uses several precisely controlled devices to assure not only that the paper is moved with minimum stress, but also that only the printed portion of the paper is moved forward, and that any unprinted portion is available for subsequent printing. This aspect is very important to the versatility of the present invention.

For purposes of example, assume that raised portion 24 of impression cylinder 22 has a total circumferential length of 11 inches. That means that, if each segment of printing plate 18 has 11 inches of image, a series of eleven inch forms can be printed by the system with each form abutting the adjacent ones. However if it is desireable to print, for instance, a 6 inch form, only 6 inches of each printing plate segment would be prepared with an image, but the printing couple would still move 11 inches of paper because raised portion 24 could not be changed. Without special accommodation, the forms would be printed with 5 inches of blank paper between them. The solution to this problem has long been recognized. It is to retract, to pull the paper backwards, opposite to direction A, exactly 5 inches for every revolution of impression cylinder 22.

The present invention uses a precise control system, not only to retact the excess paper, but also to move the printed paper forward, and to do so with exact timing and controlled acceleration and deceleration so as to not damage the paper.

The forward motion of paper 12 is derived from tractor 62 (Matching unit on other side of paper is not visible), which is powered from stepper motor 64 and controlled from process controller 66. Tractor 62 is monitored by shaft encoder 63 which measures the movement of tractor 62 and transmits signal to process controller 66. If the paper motion is not as prescribed, process controller 66 transmits a correction signal to stepper motor 64 to adjust the paper. Process controller 66 is set to attempt correction three times, and if the proper registration has not been accomplished in those three times the press shuts down so adjustments can be made. Tractor 62 is a conventional motive means for computer-type prepunched paper with holes along two edges. It is essentially a flexible belt with precisely spaced teeth which match the spacing of the perforations in the paper, running on two pulleys. Stepper motor 64 is activated by a series of electrical pulses with many pulses required for each inch of movement of tractor 62 so that control resolution can be achieved accurately. In the preferred embodiment 3600 pulses are required for one inch of movement.

To assure no interference with the printing action, tractor 62 is not activated until paper 12 has been released from the printing couple formed by raised portion 24 and blanket cylinder 20. Accurate information on the orientation of these cylinders is derived from optical encoder 69 attached to plate cylinder 16 and optical switch 71. Optical encoder 69 furnishes to process controller 66 a unique signal for every orientation of plate cylinder 16, which, because of the fixed gearing between the various cylinders, also gives information on the precise orientation of raised portion 24 of impression cylinder 22.

It is therefore possible to inititate forward motion of paper 12 precisely after release of the paper from the pinch of blanket cylinder 20 and raised portion 24.

Similarly, the recall of paper 12, opposite to direction A, can be accurately timed. The recall is actually accomplished by vacuum roller 68 which is controlled by vacuum controller 70. Vacuum roller 68 is a perforated roller which is attached to vacuum source 72. As paper 12 rides over vacuum roller 68, it slips freely if no vacuum is acting, and it is held tightly when the vacuum is operating. Therefore, the essential timing is that the vacuum is off when raised portion 24 is in contact with and moving paper 12 forward, and vacuum controller 70 activates the vacuum on vacuum roller 68 when it is desired to recall paper 12. It should be noted that vacuum roller 68 is constantly turning in a direction opposite to impression cylinder 22. This rotation is accomplished by conventional gearing (not shown), but the effect of vacuum roller 68 is limited to that portion of the print cycle during which raised portion 24 of impression cylinder 22 is not acting to move paper 12 forward.

Thus while the printing action takes place paper 12 slips freely over vacuum cylinder 68, although the surface of vacuum cylinder 68 is moving opposite to paper 12, and after the printing takes place vacuum controller 70 activates the vacuum on vacuum roller 68 which grips paper 12 and causes its motion to reverse. The gearing of vacuum roller 68 is arranged so that its speed will permit the retraction of essentially a full frame of paper when the press is operating at maximum speed, and the retraction speed therefore slows down at lower speeds. The particular benefit of vacuum roller 68 is that, while it grips the paper firmly enough to move it if there is little resistance, its system operates with an inherent override so that if the resistance to its grip is too great paper 12 will slip upon vacuum roller 68 and either remain stationary or move opposite to the movement of the vacuum roller surface direction, even when the vacuum is activated. This permits tractor 62 to be the ultimate, accurate determinator of the net amount of forward paper motion and reduces the likelihood of paper damage during recall.

In operation, paper 12 moves forward, in direction A, during the printing portion of the cycle in much the same way as an individual sheet of paper would. However an individual sheet of paper would be precut to match the length of the printed area. In the present invention, during the printing, air blaster 74, operating cyclically while paper 12 is being moved forward by the printing couple, causes the part of paper 12 which accumulates between tractor 62 and impression cylinder 22 to move downward into predetermined storage loop 76. This loop grows during the printing portion of the cycle and shrinks between printing portions, but is limited to the circumferential distance of raised portion 24, which in the preferred embodiment is approximately 11 inches.

After the printing is completed both tractor 62 and vacuum roller 68 are activated, each attempting to move the paper in opposite directions, but tractor 62, with positive spindle and hole contact with paper 12, will overcome the rearward motion of vacuum roller 68 because of the inherent override feature of vacuum roller 68. Tractor 62, because of the feedback available from shaft encoder 63, is precisely controllable as to the motion it imparts to paper 12. This furnishes not only an exact forward movement of the paper, but also permits a slow start and stop of the motion, low acceleration and deceleration, so that the paper is not unduly stressed. Moreover, the forward motion can be accurately timed, not only between the printing portions of the cycle, but also relative to the vacuum roller operation, so that it may precede, follow or act at the same time as the vacuum roller. This timing will be advantageously varied based on the nature and strength of the printing paper.

To the observer, the paper movement is most apparent from the growth and reduction of storage loop 76, but what is actually happening is that paper 12, progressing from source 79 up through guide 78, over vacuum roller 68, through web guide 80, between blanket cylinder 20 and impression cylinder 22, over tractor 62, over roller 82 and into folder 84, is moving intermittently a net total of the printing frame length during each cycle. The movement is actually the forward throw of the total circumferential length of raised portion 24 feeding into loop 76 and then the reduction of loop 76 by the forward movement of tractor 62 for the exact printing frame length, and the rearward movement caused by vacuum roller 68 of the difference between the forward throw of raised portion 24 and the forward movement of tractor 62. The net forward movement as seen at guide 78 and roller 82 is, therefore, the actual printing frame length, the portion of printing plate 18 which is actually prepared with the image of the three color segments.

Figure 2:
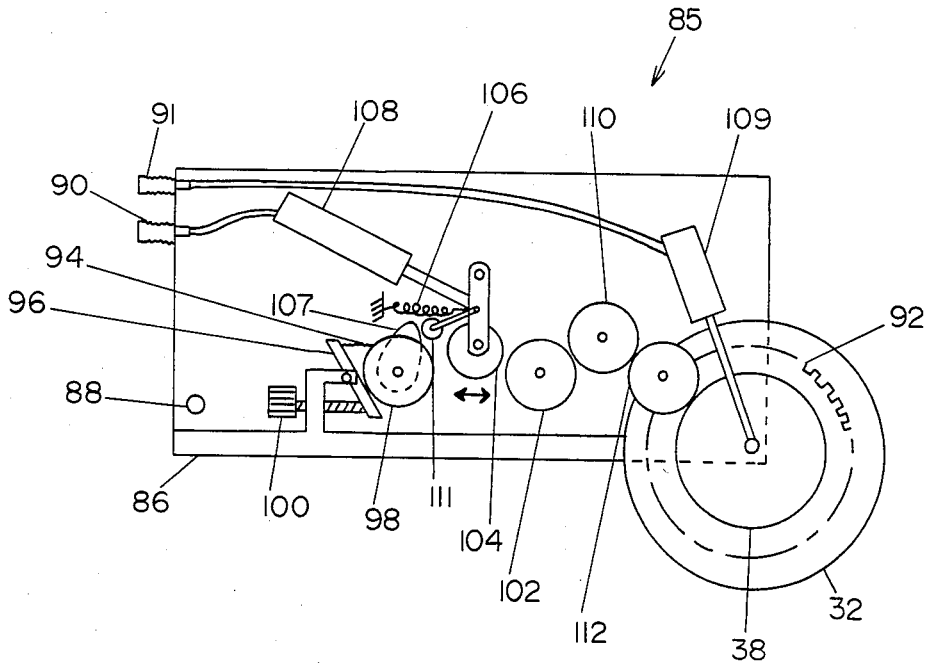
FIG. 2 is a simplified schematic view of one of the ink modules of the invention removed from the printing press.

FIG. 2 is a simplified schematic view of typical inking module 30 of the present invention from which the near side frame has been removed for clarity of viewing:

The entire ink module 85 for each color is assembled onto demountable frame 86 which slides into guide 48 (FIG. 1) for operation on the printing press. The only attachments required to activate ink module 85 are the insertion of locking pin 50 (FIG. 1) into locking hole 88 to hold ink module 85 securely in place and the attachment of air lines 51 from air controller 53 (FIG. 1) to the ink modules' air connectors 90 and 91. Drive gear 92 automatically meshes with a matching gear on the printing press (not shown) and provides the mechanical drive required to drive the rollers of the ink module through a gear train of conventional design (not shown).

Each of the rollers on ink module 85 operates in a conventional manner, together accomplishing the proper distribution of ink onto printing plate 18 (FIG. 1). Ink 94 progresses from ink blade 96, onto which it is customarily loaded by hand, to ink fountain roller 98. The thickness of the layer of ink on fountain roller 98 is adjustable by the operator by turning screw thread adjustor 100 to adjust the clearance between ink fountain roller 98 and ink blade 96. A series of these adjustors parallel to the axis of the roller permit variations of ink depth along roller 98.

The ink is transferred intermittently from ink fountain roller 98 to ink transfer distributor 102 by ink ductor 104 which oscillates between them. Ink ductor 104 is spring loaded in one direction by spring 106 and is moved in the other direction by cam 107 acting on cam follower 111 to provide the movement between ink fountain roller 98, from which ink ductor 104 picks up the ink, to ink transfer distributor 102 upon which it deposits the ink. The period of time which ink ductor 104 spends in contact with ink fountain roller 98 determines the amount of ink ultimately applied to ink form roller 38 and to printing plate 18. As previously described, wheel 32 rides upon ring cam 34 (shown in FIG. 1) concentric with the plate cylinder 16, and lifts ink form roller 38 away from printing plate 18 when appropriate. However, pneumatic cylinder 109 also permits lifting ink form roller completely off of printing plate 18, for instance, when not printing during startup and at shutdown.

Ink roller distributor 110 and ink oscillator 112 act in a conventional manner to evenly distribute the ink across and around the rollers before final application of ink 94 to ink form roller 38.

Pneumatic cylinder 108 is used to prevent ink flow at start-up and shutdown of the press to eliminate excess ink buildup. It acts by holding ink ductor 104 away from ink fountain roller 98 to prevent ink from transferring. The combination of ink ductor 104 and pneumatic cylinder 108 provide versatility to the module in that, with appropriate control, the ink source can be completely cut off by holding-ink ductor 104 against ink transfer distributor 102. This means that ink flow can be started or stopped. As will be discussed later, this feature is particularly beneficial during automatic start up or automatic shut down.

The total construction of ink module 85 is also specifically beneficial in that, as is apparent from its construction, its removal and replacement is extremely simple and can be done rapidly and by inexperienced personnel.

Figure 3:
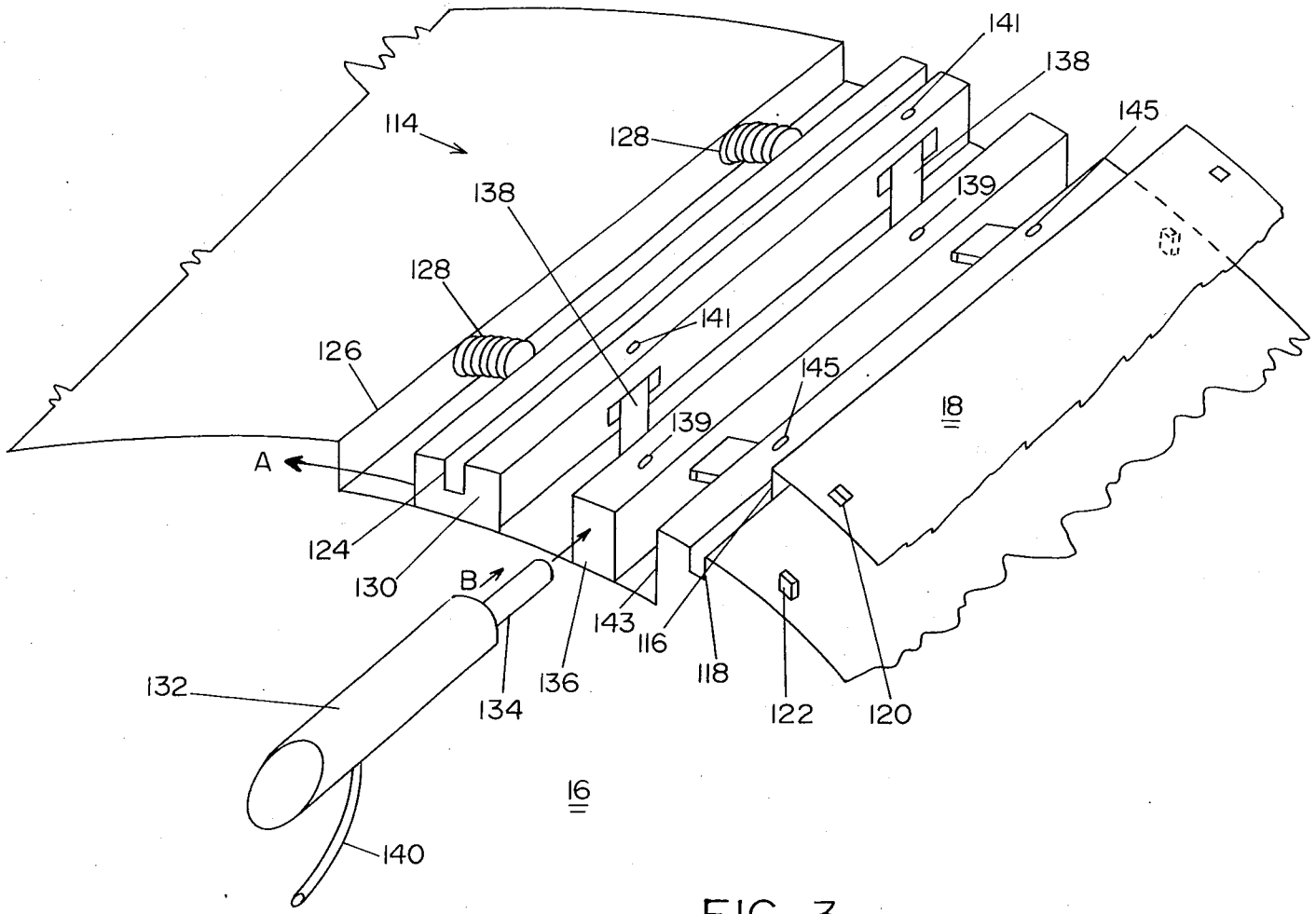
FIG. 3 is a simplified perspective view of the quick release printing plate retaining mechanism.

Another particularly beneficial aspect of the printing press of the present invention is the quick release printing plate retaining mechanism depicted in FIG. 3. Quick release retainer 114 is built into the cylindrical surface of plate cylinder 16 and holds printing plate 18, which is a thin metal sheet with its end edges 116 bent at angles to the printing surface.

For attaching printing plate 18, one bent edge 116 is slipped into registry slot 118 and printing plate 18 is oriented laterally so that its long edges are within the edges of plate cylinder 16 and printing plate registry holes 120 are slipped over registry pins 122.

The surface of printing plate 18 is then wrapped around plate cylinder 16, usally using a control for jogging the motor and slowly rotating plate cylinder 16 as the operator feeds printing plate 18 along plate guide 19 (FIG. 1). When printing plate 18 is wrapped completely around plate cylinder 16, its other bent edge (not shown) is inserted into slot 124.

Slot 124 is normally held away from edge 126 of plate cylinder 16 by compression springs 128, thereby tensioning printing plate 18 around plate cylinder 16, and, along with several registry pins 122 preventing any slippage which would cause misregistry. For loading and unloading, however, retaining block 130 in which slot 124 is located is moved a sufficient distance closer to edge 126, and opposed to springs 128, to release the tension on printing plate 18, and permit the edges 116 to be lifted from their respective retaining slots.

This movement is accomplished by the unique mechanism shown in FIG. 3, and is particularly suited for automatic operation since it requires only a single motion, provided by pneumatic cylinder 132 whose piston 134 pushes in direction B against actuator bar 136, to move retainer bar 130 in direction A.

As actuator bar 136 moves in direction B it pivots on wings 138 and both moves in direction A and forces retaining block 130 to move in direction A, thus compressing springs 128 and relieving the tension on printing plate 18 so its bent edges 116 can be removed from retaining slots 118 and 124.

Actuator bar 136 has two pairs of wings 138 pivotably attached to it so that each pair pivots around a single pivot point 139 attached to actuator bar 136. The opposite end of one wing 138 of each pair is also pivotably attached to retainer bar 130 by pivots 141, while the opposite end of the other wing 138 of each pair is pivotably attached to a fixed surface 143 of plate cylinder 16 at pivot points 145. Retainer bar 130 is restricted in its movement in direction B by guides (not shown) so that force on actuator bar 136 in direction B causes a vector force on it from fixed surface 143 by way of wings 138, and actuator bar 136, in turn, produces a vector force on retainer bar 130 by way of wings 138 to force retainer bar 130 in direction A. Release of the printing plate is therefore accomplished by the simple motion of pneumatic cylinder 132 operated by air line 140 from a pneumatic controller (not shown), as opposed to the more traditional and time consuming methods of using wrenches.

Once released from slot 124, printing plate 18 is fed onto plate guide 19 while plate cylinder 16 is slowly rotated to move it around to a location where the other end of printing plate 18 is available for removal.

Figure 4:
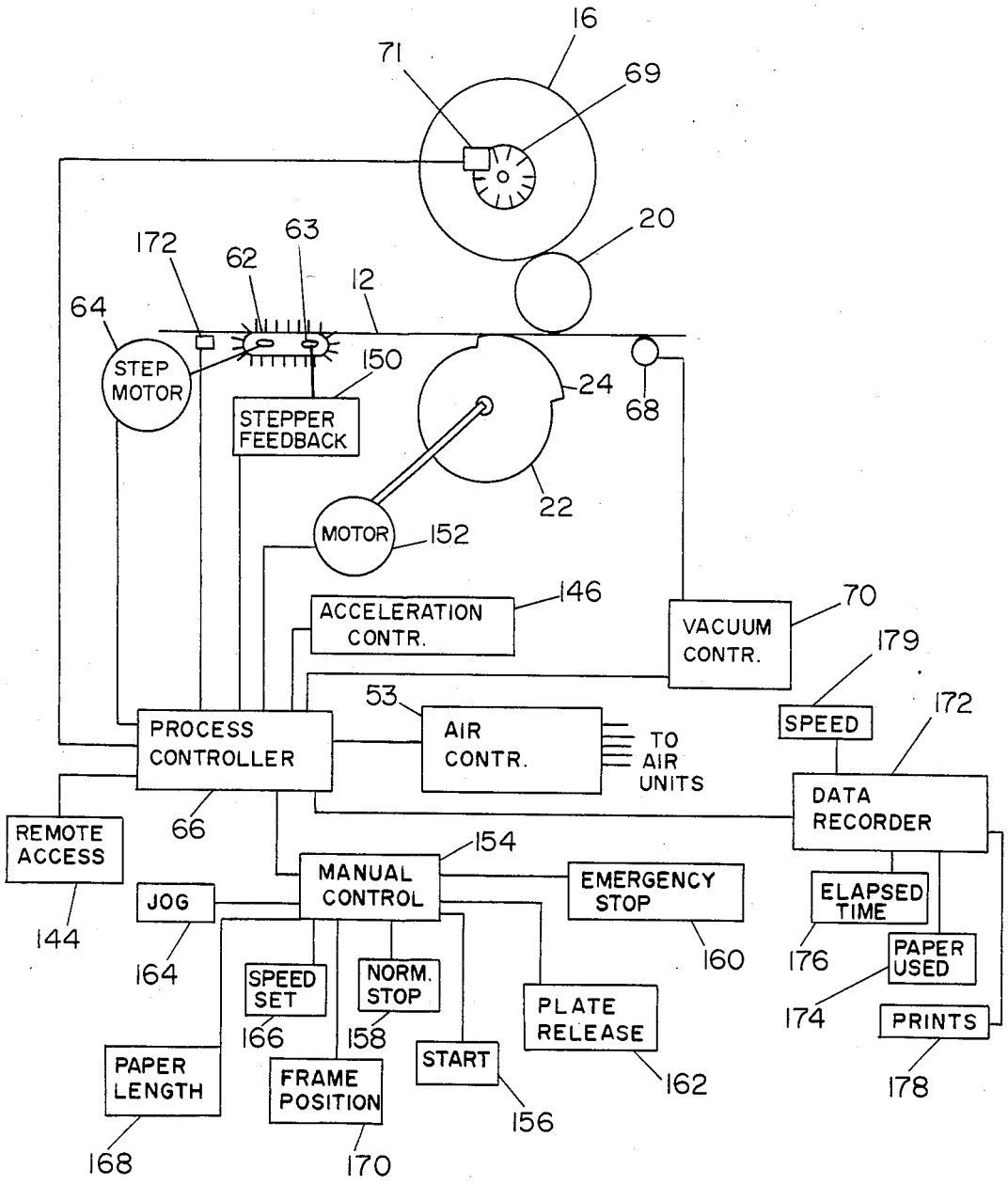
FIG. 4 is a simplified block diagram of the control system of the preferred embodiment.

FIG. 4 depicts a simplified schematic diagram of the control system of the present invention which coordinates the various other features of the present invention and operates a sequence of start-up and stopping the printing press which implements the fast change-over system and permits profitable short run operation.

These start and stop control sequences permit automatic starting upon the actuation of one control and a similar automatic sequence of shut-down which leaves the press in condition for a very rapid change of printing plate.

On start up, assuming the printing plate has already been mounted on the plate cylinder, the paper has been threaded into its path, and the ink modules installed and filled with ink, the start sequence operates as follows in reference to FIG. 1 and FIG. 2.

1. Rotation of the press begins. All cylinders are interrelated by a gear train so that all begin moving and are synchronized together. Optical encoder 69, attached to plate cylinder 16, and optical switch 71 furnish information on the orientation and the number of rotations of the plate cylinder past a specific point in the cycle at which the control system produces a count.

2. After one count from plate cylinder 16, liquid assembly 52 is turned on by activating its source pump 57.

3. After three more counts from plate cylinder 16 to assure even distribution of the liquid on liquid roller 54, liquid roller 54 is placed into contact with printing plate 18 on plate cylinder 16 by the action of pneumatic cylinder 55. This begins the wetting of printing plate 18.

4. After 10 more counts from plate cylinder 16 to assure complete and even distribution of liquid on the printing plate, the ink modules are activated by dropping ink form rollers 38, 44 and 46 into contact with their respective ring cams, by activating pneumatic cylinder 109, and two counts later, turning on their respective ink supplies by initiating the normal oscillation of ink ductor 104 by unlocking it with pneumatic cylinder 108.

5. After five more counts the movement of paper 12 is initiated by activating tractor 62 by powering stepping motor 64. Also cyclic air blaster 74 is initiated and vacuum is applied to vacuum roller 68 by vacuum controller 70.

6. At the same time blanket cylinder 20, which has, until now been remote from plate cylinder 16 and impression cylinder 22, is also pressed against them by pneumatic cylinder 21 and the printing process also actually begins.

It can thus be appreciated that other than activating a single control, and selecting a speed of operation, the operator is able to merely stand-by and the printing press automatically progresses through its starting sequence.

The shut off operation of the press is similarly automatic. Although an emergency stop control 160 is available to stop all motion of the press in case of a hazardous condition, the normal stop sequence takes a short time and is initiated by the actuation of "Normal Stop" control 158.

The following stop sequence is then begun:

1. Immediately, ink form rollers 38, 44 and 46 are lifted from their ring cams by pneumatic cylinder 109 and the ink supplies are cut off by pneumatic cylinder 108 stopping the oscillation of ink ductor 104.
2. After two counts, liquid roller 54 is lifted from contact with printing plate 18 by pneumatic cylinder 55 and liquid pump 57 is shut off.
3. After one additional count, blanket cylinder 20 is lifted away from the other cylinders by pneumatic cylinder 21 and stepping motor 64, air blaster 74 and vacuum are turned off.
4. After one additional count, plate cylinder 16 is rotated to the specific orientation at which pneumatic piston 134 is aligned with actuator bar 136 and stopped there.
5. After the press is stopped the control program is reset to permit another sequential start and a sequential stop.

The stop sequence described cleans printing plate 18 of its ink and, as noted above, aligns the quick release mechanism of the printing plate so that actuation of a single control releases it for replacement.

The previously described control sequences are accomplished by the control system shown in simplified block form in FIG. 4.

The heart of the system is process controller 66, which is programable both manually and, by use of conventional technology, remotely by use of remote access 144. As described above, an important function of process controller 66 is control of the acceleration of paper 12 as it is moved forward by tractor 62 and backward by vacuum roller 70. The acceleration and deceleration these devices impart to paper 12 is electronically determined by acceleration control 146.

In the preferred embodiment this control limits the acceleration in relation to the rotational speed of the press in several steps. The lowest acceleration value is used up to 20 revolutions per minute of the press, a higher acceleration rate is used at press rotations up to 40 RPM, and the higher values of acceleration are sued in 20 RPM steps. Since higher speeds of rotation permit less time to move the paper between impressions, acceleration and deceleration must increase at higher speeds. This increase could also be made continuous rather than as changeovers at specific ranges.

The physical action that actually takes place to move paper 12 forward is motion of tractor 62 powered by stepper motor 64 which is itself activated by an electronic pulse signal from process controller 66. The speed of stepper motor 64 is varied by changing the repetition rate of the pulse signal. Acceleration control 146 therefore regulates the rate of change of the pulse repetition rate and thereby controls the acceleration of paper 12.

Process controller 66 also accurately controls the actual movement of paper 12 by use of a feed back system. While, on one hand, generating the signal to drive stepper motor 64 and tractor 62, process controller 66, by means of shaft encoder 63 feeding signal to stepper feedback system 150, also verifies that paper 12 is actually moving at the prescribed distance. If the movement is not as intended the entire press is automatically shut down after three attempts to correct it automatically. The press motion is controlled by process controller 66 which controls motor 152 which drives impression cylinder 22. A conventional gear drive powers the various other rotating components, such as blanket cylinder 20 and plate cylinder 16, from the rotation of impression cylinder 22.

The control system requires a limited number of decisions from the press operator, and this information is all entered into the system by manual control 154. As described previously, these manual controls include start 156, normal stop 158, emergency stop 160 and plate release 162. Jog control 164 is also available to permit limited slow rotation of the plate cylinder for use when removing or installing printing plates.

Speed set control 166 is furnished to adjust the press speed although in normal operation little variation would be likely. As previously described, paper length control 168 is used to control the length of paper used for each printed item. It is this setting which the stepper feedback 150 aims for. It acts by activating stepper motor 64, through process controller 66, for a specific number of steps which are related to the paper size desired, but is independent of the printing placed upon the paper. While under typical operation the paper movement would be set to match the printed item an interesting example of the versatility of the present invention is that the press can be made to produce material which appears to alternate between printed material and blank sheets. This is accomplished by setting paper length control 168 for twice the printed surface length. While this seems an odd product, it may, in fact, be used to preprint part of a set of forms which can be completed individually by computer or even typewriter.

Frame position control 170 permits orienting the printed work with features of the paper web. If, for instance, paper 12 is perforated every 11 inches and it is desired to print something centered between perforations, it is necessary to align the paper with the press motion. This can be done manually by visual inspection of the product and adjustment of frame position control 170 manually. It can also be accomplished by use of optical sensor 172 which notes the passage of the appropriate feature of paper 12.

The actual adjustment of frame position is accomplished by process controller 66 which controls the stopped position of tractor 62 relative to the paper feature so that when raised portion 24 of impression cylinder 22 first hits paper 12, the paper, which has been drawn taunt in the backward direction by vacuum roller 68, will be in the exact location required for proper frame position. It should be noted that both frame position and paper length can if desired, be adjusted while the press is operating.

Vacuum roller 68 is activated and controlled by vacuum controller 70, which is properly timed by electrical signals generated by process controller 66.

Similarly, air controller 56 is also timed by process controller 66 so that the several functions it controls, such as cyclic air blaster 74, blanket cylinder pneumatic cylinder 21 and the air actuated devices in liquid assembly 52 and the ink modules, are all precisely timed relative to the other control functions.

A particularly beneficial feature of the present invention is the availability of electrical signals from process controller 66 for use as data sources. Thus, tractor encoder 148 furnishes information to data recorder 172 which then displays the amount of paper used on display 174. Similarly, the time from one operation of plate release control 162 until its next operation furnishes elapsed time on each job for display on elapsed time display 176. Also print display 178 indicated the number of revolutions of impression cylinder 22 and therefore indicates the number of printed items produced.

Perhaps the most visible display is speed display 179 which by use of information from optical switch 71, continuously displays the momentary speed of the press in impressions per minute.

These data displays therefore produce the basic accounting information required for each printing job, the material used, the labor time spent and the product produced. Data recorder 172 yields a hard copy of this same data, which is all that the production supervisor needs, but if other data is required the electronic signals are all accessible in process controller 66 and need only be tapped.

In all, the present invention is a complete, virtually automatic, printing system which so reduces job set-up time, paper waste, and even job record keeping, that wet offset printing is now economically viable for shorter press runs than have ever been available before.

It is to be understood that the form of this invention as shown is merely a preferred embodiment. Various changes may be made in the function and arrangement of parts; equivalent means may be substituted for those illustrated and described; and certain features may be used independently from others without departing from the spirit and scope of the invention as defined in the following claims.

For instance, the modular ink system could be used on a single or four color press, and the acceleration control feature for paper movement and the sequential start and stop sequences are also independent of the number of colors on the press. Moreover, frame position and paper length adjustment electronically are useable with many paper retraction means. Furthermore the quick release printing plate clamp can also be used in other rotary presses.

What is claimed as new and desired to be secured by Letters Patent of the United States is:

1. A quick release printing plate retaining apparatus for holding a printing plate on the surface of a plate cylinder comprising:

a first fixed groove in the cylindrical surface of the plate cylinder and oriented parallel to the axis of the plate cylinder into which fits a lip bent on the edge of a printing plate;

a segment of the cylindrical surface of the plate cylinder with a reduced radial dimension forming a depressed surface;

a moveable retainer bar including a second groove, into which fits a lip bent on the edge of a printing plate, parallel to the first fixed groove, the moveable retainer bar located within the depressed surface of the plate cylinder;

force producing means acting upon the moveable retainer bar to move it toward the first fixed groove and to maintain clearance space within the depressed surface on the side of the retainer bar away from the fixed groove;

an actuator bar located within the depressed surface of plate cylinder between the moveable retainer bar and the fixed groove and oriented approximately parallel to the plate cylinder axis;

at least two pair of wing means angularly oriented at complimentary angles to the axis of the plate cylinder and pivotably attached to the actuator bar, each pair having one wing means protruding toward the retainer bar and pivotably attached to it and another wing means protruding toward the first fixed groove and pivotably attached to a fixed surface; and actuating means capable of producing a force on the actuator bar in the direction parallel to the axis of the plate cylinder from the direction of the apex of the angles formed by the wing means.

2. The printing plate retaining apparatus of claim 1 wherein the actuating means is a pneumatic cylinder whose piston produces the force on the actuator bar, but which does not contact the actuator bar when not producing the force so as not to interfere with the rotation of the plate cylinder.

* * * * *